US007494085B2

(12) United States Patent
Bordignon et al.

(10) Patent No.: US 7,494,085 B2
(45) Date of Patent: Feb. 24, 2009

(54) REELING DEVICE FOR SEMI-FINISHED ROLLED PRODUCTS

(75) Inventors: Giuseppe Bordignon, Bicinicco (IT); Andrea De Luca, Remanzacco (IT); Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 256 days.

(21) Appl. No.: 10/567,545

(22) PCT Filed: Aug. 6, 2004

(86) PCT No.: PCT/EP2004/051744

§ 371 (c)(1),
(2), (4) Date: Feb. 6, 2006

(87) PCT Pub. No.: WO2005/051560

PCT Pub. Date: Jun. 9, 2005

(65) Prior Publication Data

US 2006/0266870 A1 Nov. 30, 2006

(30) Foreign Application Priority Data

Aug. 8, 2003 (IT) ..... MI2003A1637

(51) Int. Cl.
*B65H 54/28* (2006.01)

(52) U.S. Cl. ..... 242/478

(58) Field of Classification Search ..... 242/476.9, 242/478, 615.3, 480.9, 481, 482.9, 483.3, 242/484.4, 484.2, 157.1, 397, 397.1, 397.2, 242/397.5

See application file for complete search history.

(56) References Cited

U.S. PATENT DOCUMENTS

| | | | |
|---|---|---|---|
| 3,507,458 A | 4/1970 | Merchant et al. | |
| 4,143,834 A | 3/1979 | Hara et al. | |

FOREIGN PATENT DOCUMENTS

| | | | |
|---|---|---|---|
| DE | 821 666 | | 11/1951 |
| DE | 12 67 507 | | 5/1968 |
| DE | 33 06 579 | | 8/1984 |
| EP | 1 126 935 | | 8/2001 |
| JP | 05 229733 | | 9/1993 |
| JP | 10-157927 | * | 9/1993 |
| JP | 05-229733 | * | 6/1998 |
| JP | 10 157927 | | 6/1998 |

OTHER PUBLICATIONS

Machine Translation of DE 821666.*

* cited by examiner

*Primary Examiner*—Peter M Cuomo
*Assistant Examiner*—William E Dondero
(74) *Attorney, Agent, or Firm*—Sampson & Assoc

(57) ABSTRACT

A device for reeling semi-finished rolled products comprises two sections (1, 2) connected together to form an articulated arm that guides the product (BL) coming out of a rolling mill onto the reel that is being wound. The second section (2), which is closer to the reel, during winding, maintains its own inclination constantly equal to the inclination of the turns of the reel. This enables a considerable reduction of the gap between the adjacent turns and prevention of any overlapping (i.e., climbing on top of one another) between the turns already wound and the turns being distributed on the same layer. Reels that are more compact and have a more precise geometry are thus obtained. Also described is a device (12) for guiding the rolled product (BL) arriving on the reel with greater precision.

10 Claims, 5 Drawing Sheets

Fig. 2-bis

REELING DEVICE FOR SEMI-FINISHED ROLLED PRODUCTS

This application claims priority to PCT/EP2004/051744 entitled "A reeling device for semi-finished rolled products", filed on 6 Aug. 2004, which claims priority to Italian Patent Application No. MI2003A001637, filed on 8 Aug. 2003.

FIELD OF THE INVENTION

The present invention relates to a reeling device for semi-finished rolled products, such as round bars, flat bars, rods, or wire rods (whether smooth or ribbed) of hot-rolled metal material, which have, for example, a round, square, rectangular or hexagonal cross section.

PRIOR ART

A device for guiding the formation of the turns of a skein of hot-rolled products, known in the state of the art, is described in the European patent No. EP1.126.935 filed in the name of the present applicant and is schematically illustrated in FIG. 1. Said device comprises a distributor D having an elongated shape, which can oscillate about a fixed vertical axis AV, inside which there slides a hot-rolled bar, which is guided by said distributor on the spindle of a reel B rotating about a horizontal axis AO. This device further comprises guides that maintain the rolled material that is to be wound constantly perpendicular to the axis of the winding reel so as to obtain a more constant formation and distribution of the turns. As may be seen from FIG. 1, a drawback of this solution is that, in the case of rolled material having a square or rectangular cross section, when the distributor D has an inclination $\gamma$ opposite to the angle of winding $\alpha$ of the turns, the flat bar coming out of the distributor D surmounts and in part overlaps the last turn already wound on the reel; that is, there is a so-called "overlapping between the turns".

The overlapping of the turns inevitably causes damage of the rolled material on account of the deformations and scratches that are generated thereby, and this occurs at the expense of the quality of the end product. Said overlapping moreover causes an irregular final shape, which has repercussions on the final shape of the skein.

A solution for overcoming said drawback could be that of increasing the distance between the turns, i.e., increasing the pitch of the winding given the same cross section of the rolled material to be wound. In this way, however, the various turns cannot be compacted against one another so that less compact reels would be obtained.

SUMMARY OF THE INVENTION

The purpose of the present invention is to provide a device for reeling semi-finished rolled products that will represent an improvement over devices of a known type, in particular with reference to the problem outlined above of overlapping of the bar arriving on the reel with respect to the turns already formed on the same layer in order to obtain skeins of good quality and with a geometrically more orderly arrangement of the turns.

Another purpose of the present invention is to obtain a compact and perfectly cylindrical shape of the skein (optimal shape) and with a high filling coefficient. The advantages that result therefrom are smaller overall dimensions, a better exploitation of storage space in the warehouse, as well as optimization of transportation.

The above purposes are reached, according to a first aspect of the present invention, by means of a device having the features of claim 1, and, according to a second aspect of the present invention, with a method having the features of claim 8.

Further advantages that may be achieved with the present invention will emerge more clearly, to the person skilled in the sector, from the following detailed description of a non-limiting example of a particular embodiment, with reference to the following figures.

LIST OF FIGURES

Figure 3:
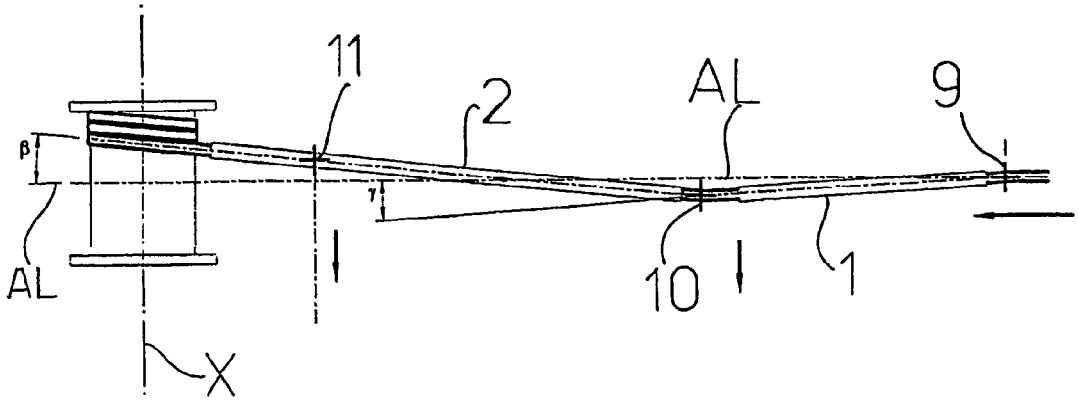
Figure 2:
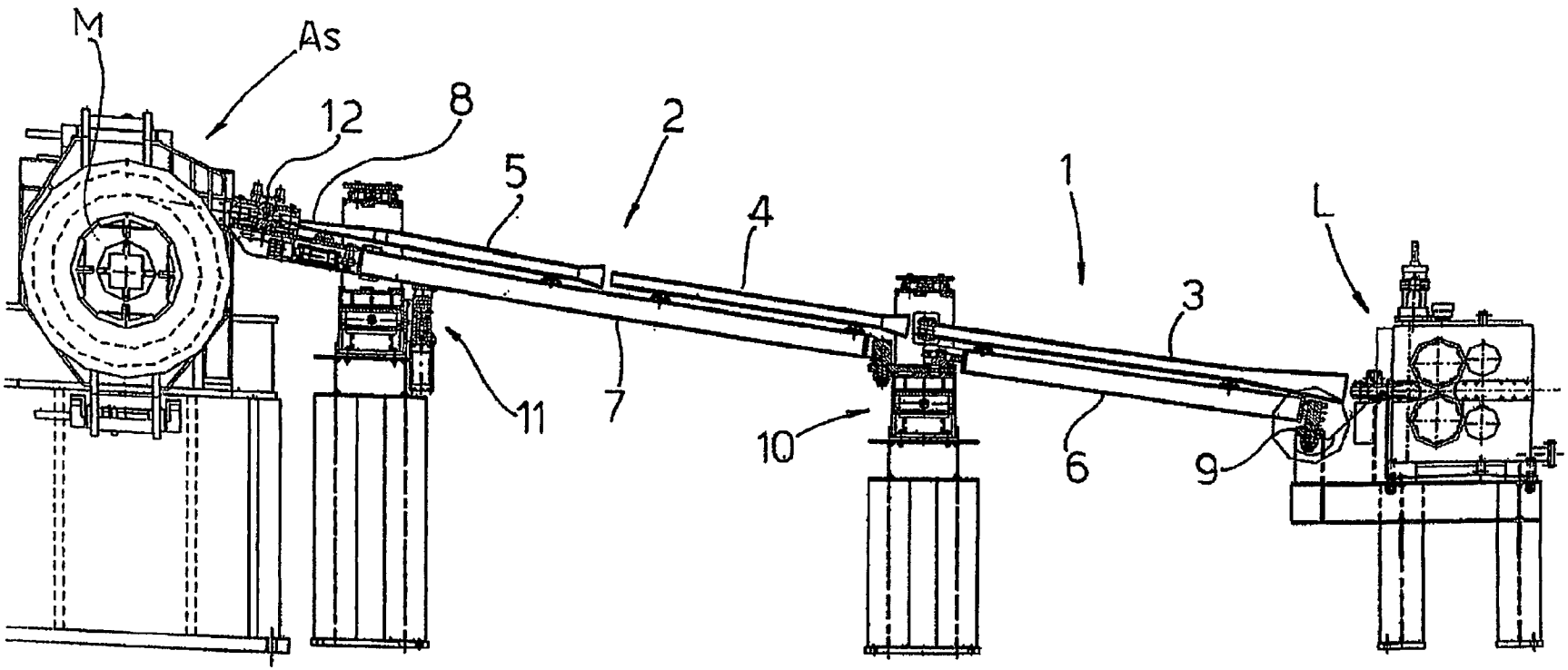
FIG. 2 is a schematic, partially sectioned, side view of a particular embodiment of a reeling device of a known type for winding in turns a bar of rolled material.
Figure 3:
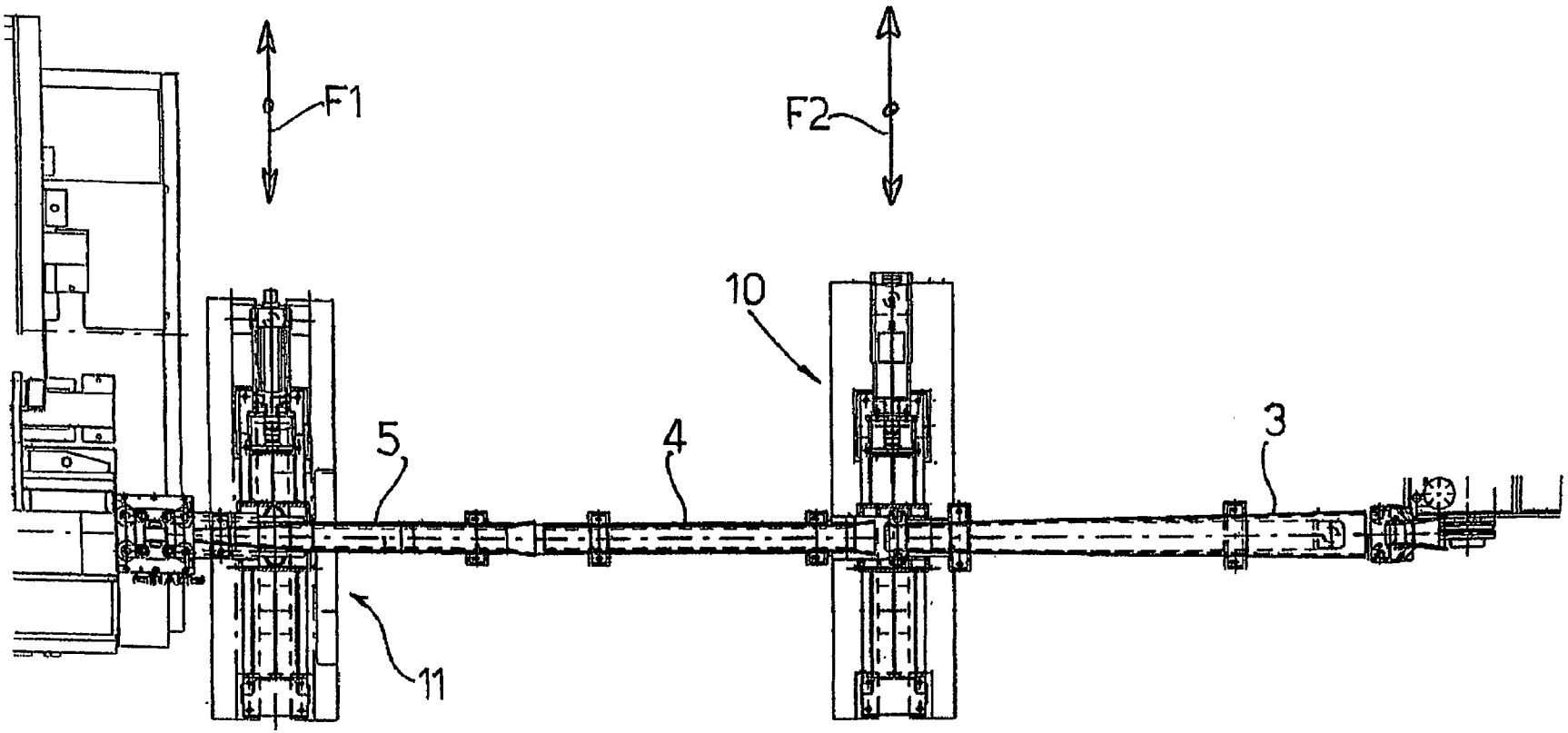
Figure 4:
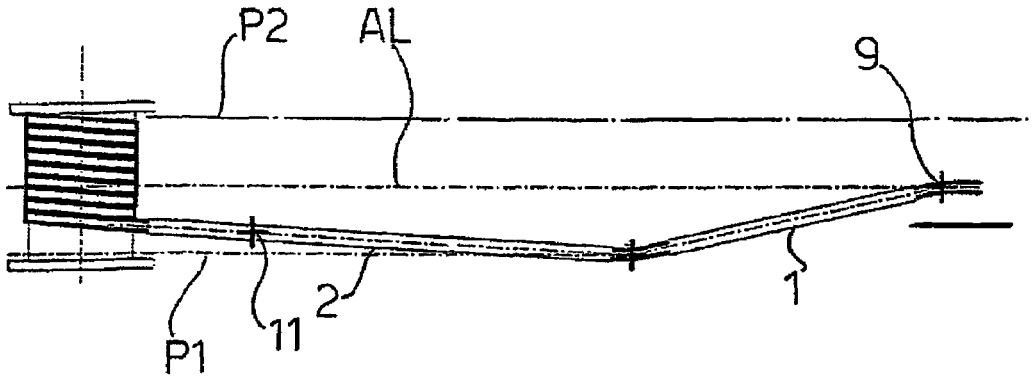
Figure 5:
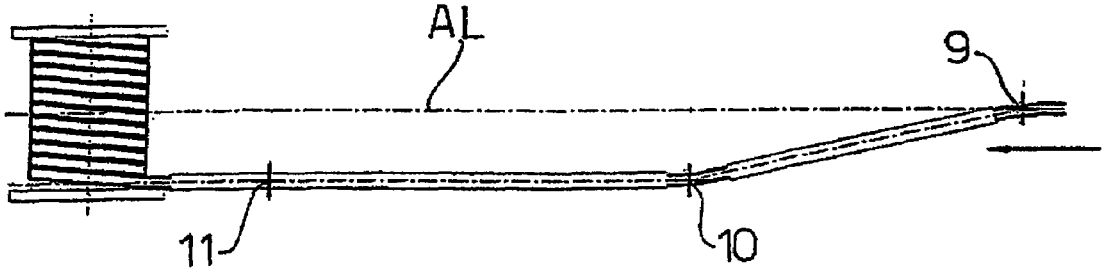
Figure 6:
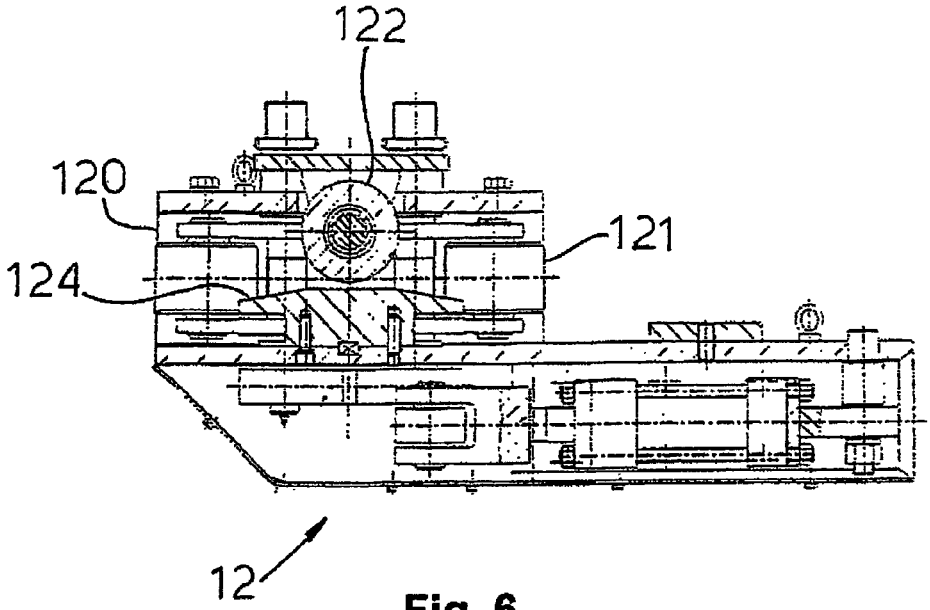
Figure 7A:
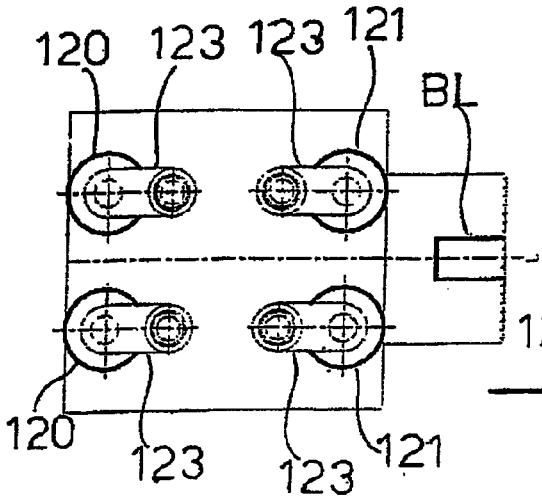
Figure 7B:
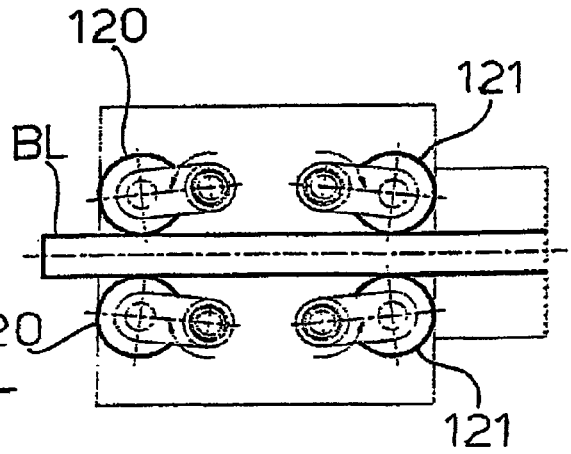

FIG. 2-*bis* is a schematic top view of the distributing device of FIG. 2;

FIGS. 3, 4, and 5 are schematic top views of three stages of an example of operation of the distributing device of FIGS. 2, 2-bis;

FIG. 6 is a schematic cross-sectional side view of a device for guiding the bar at output mounted on the distributing device of FIG. 2; and FIGS. 7A and 7B are schematic top views of two stages of the operation of the bar-guiding device illustrated in FIG. 6.

DETAILED DESCRIPTION

FIG. 2 is a schematic, partially sectioned, side view of a non-limiting example of embodiment of the reeling device according to a first aspect of the present invention, i.e., for winding in turns a metal material (not represented) coming off a rolling line L. In the present example of embodiment, the rolled material has a square or rectangular (i.e., flat) cross section.

The example of embodiment of FIG. 2 of the reeling device according to the present invention comprises a first guide element 1 and a second guide element 2, each of which is made in the form of one or more tubular bodies 3, 4, 5 supported by two beams 6, 7.

With reference to FIG. 2-*bis*, it may be noted that the tubular body 3 is much more splayed with respect to the tubular bodies 4, 5 in order to enable conveying of the rolled material, which comes off the train of rolls, within said tubular body 3 without there occurring any lateral sliding.

One end of the tubular body 3, referred to as input end of the first guide element 1, is set on the axis of rolling of the rolling mill L in front and in the proximity of its outlet in such a way that the bar of rolled material may slide easily inside the tubular body 3 itself. The opposite end of the tubular body 3 (in the present description referred to as output end of the first tubular body 1) is set in the proximity of one end (referred to in what follows as input end of the second guide element 2) of the tubular body 4 in such a way that, whilst the distributor performs the movements described hereinafter, a rolled flat steel material, or other material, coming out of the rolling mill L may traverse in succession, sliding within them, the three tubular bodies 3, 4, 5 and come out from the output end 8 of the second guide element 2, and from there reach the reel AS and the corresponding winding spindle M, on which the rolled flat material is bent so as to form the turns of a reel. The tubular bodies 3, 4, 5 and the corresponding supporting beams 6, 7 have, that is, the function of supporting, containing and guiding the metal bar coming out of the rolling mill towards a precise position of the winding spindle M, which, in the present example of embodiment, turns about a horizontal axis.

The guide element 1 in the proximity of the output of the rolling mill L is fixed to the fixed hinge 9 (FIG. 2), which enables it to rotate about a substantially vertical axis, more precisely about an axis orthogonal to the plane of lie of said first guide element 1, and possibly about a horizontal axis.

The guide elements 1, 2 are fixed to the two mobile supports 10, 11—which, in the present example, consist of two slides. The mobile support 11 is fixed in the proximity of the output end 8 of the tubular body 5, whilst the mobile support 11 is fixed in the proximity of the output end of the first guide element 1 and of the input end of the second guide element 2, so as to support both of them. More in particular, the mobile support 10 is provided with a pneumatic cylinder, on which there rests the beam 7 that enables raising of the second guide element 2 so as to follow the increase in diameter of the reel as this is wound. With this system, the weight of the distributor portion comprised between the two mobile supports 10, 11 is prevented from weighing on the rolled material as the diameter of the reel increases.

Both of the mobile supports 10, 11 are able to slide horizontally in the two senses according to directions parallel to the axis X of rotation of the spindle M, as indicated by the arrows F1, F2 in FIG. 2-*bis*.

By causing the mobile supports 10, 11 to translate, the first guide element 1 and the second guide element 2, according to a first aspect of the present invention, may vary the respective inclinations with respect to one another and with respect to the axis X of the spindle M or else with respect to the axis of rolling AL, where said inclinations are considered according to planes parallel to the axis of the spindle itself, independently of one another. In particular, in the example described herein (FIG. 3), the first guide element 1 and the second guide element 2 may vary irrespective of their inclinations, which are indicated respectively by the angles $\gamma$ and $\beta$, with respect to the axis of rolling AL. The angle $\gamma$ is measured on the plane of lie of the first guide element 1 with respect to the projection of the axis of rolling AL on said plane. The angle $\beta$, instead, is measured on the plane of lie of the second guide element 2 (referred to as plane of distribution) with respect to the projection of the axis of rolling AL on said plane. More in general, the angle of inclination $\beta$ of the second guide element 2 is measured in a plane that contains the axis of said second guide element 2 and that is parallel to the X axis of the winding spindle M with respect to the projection of the rolling axis AL on said plane.

Figure 1:
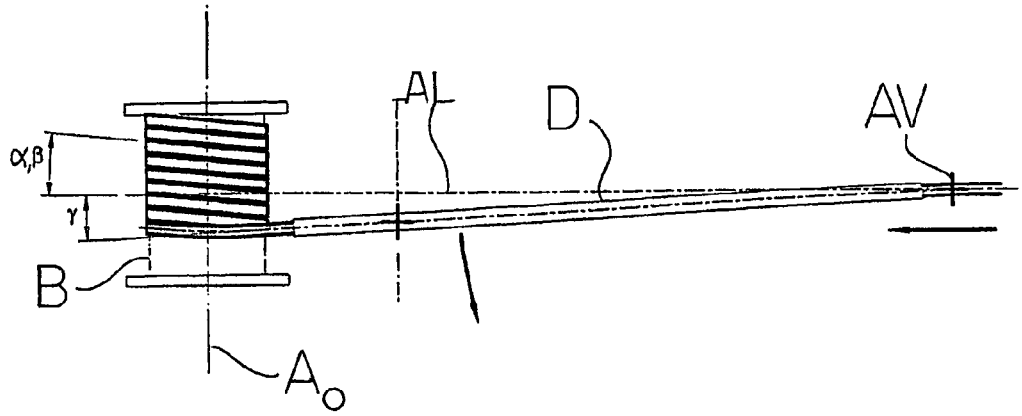
FIG. 1 is a schematic view from above of a reeling device of a known type for winding in turns a bar of rolled material.

The angle $\alpha_i$ is the angle of inclination of the helix of winding of the turns of the i-th layer (i=1, 2, 3, . . . ) with respect to the rolling axis AL (FIG. 1), and its value is determined by the following parameters:

winding pitch, which is given by the sum of the width LAR of the rolled material and by the distance, or gap, GP that is left between the turns; $\alpha_i$ is directly proportional to (LAR+GP); and number of the i-th layer of turns during distribution, and thickness H of the rolled material; $\alpha_i$ is inversely proportional to said parameters and hence to the diameter of the skein measured on the last layer of completed turns.

There now follows a description of an example of operation of the device just described.

FIG. 3 is a schematic illustration of a first instant of the operation of the distributor of FIGS. 2, 2-bis. In said operation step the carriages 10, 11 translate by displacing the articulated arm of the distributor in such a way that the output end 8 of the second guide element 2 moves along the winding spindle M in a direction substantially parallel to its axis X and in such a way that said second guide element 2 translates, remaining substantially parallel to itself, with an inclination such that the stretch of rolled material coming out of the output end 8 will have an inclination rolled $\beta_i$ (referred to as angle of distribution) substantially equal to the angle $\alpha_i$ of the helix of the turns of the i-th layer.

The end plane P1 indicated in FIG. 4 is a vertical plane orthogonal to the axis X of the spindle and passing in a position corresponding to one end of the spindle itself or, more precisely, in a position corresponding to one end of the reel of rolled bar to be formed.

When the mobile carriage 10 has reached the end plane P1, it is halted, the first guide element 1 stops rotating about the substantially vertical axis passing through the hinge 9, and only the second guide element 2 continues to rotate in a counterclockwise direction, with reference to FIG. 4, until also the second carriage 11 has brought the output end 8 into a position corresponding to the end plane P1 (FIG. 5).

At this point, the overlapping of the end turns must be obtained in each case in order to enable the diameter jump, i.e., in order to start to distribute the rolled material on top of the turns already wound on the entire table of the spindle in the preceding pass. In said step, then, the distributor assumes the configuration of distribution for the (i+1)-th layer and reverses the motion. The guide element 1 and the guide element 2 start to rotate in a clockwise direction, as viewed in FIGS. 3 to 5, in such a way that the rolled material will be conveyed onto the (i+1)-th layer of turns with an angle of distribution $\beta_{i+1}$ equal to the angle of inclination $\alpha_{i+1}$ of the turns of the (i+1)-th layer on the reel, i.e., $\beta_{i+1}=\alpha_{i+1}$. Said angles are of opposite sign with respect to the ones considered for the i-th layer. The device according to the invention, consisting of at least two guide elements articulated together and—in the present example of embodiment—actuated by at least two independent carriages, enables conveyance of the rolled material into the exact point in which it must be positioned and with a practically equal angle of distribution—at least during winding of the central part of the reel—to that of the helix of winding of the i-th layer. This enables:

a) preventing the portion of rolled bar that is coming out of the end 8 of the distributor from overlapping, even just in part, the turns that are already wound during the same pass; and a) reducing the distance, or gap, between two adjacent turns.

In the example of embodiment represented, the distributor is preferably, but not necessarily, provided, at the output end 8, with a device for guiding the bar 12 (FIGS. 2, 6, 7A, 7B), which has the function of positioning the rolled bar coming out of the end 8 of the tubular body 5 with greater precision on the winding spindle M.

Said device for guiding the bar 12 comprises a first pair of idler rollers 120 and a second pair of idler rollers 121, all four designed to guide and contain laterally in a horizontal direction the rolled bar BL that passes between them. In fact, the axes both of the rolls 120 and of the rolls 121 are vertical or in any case inclined with respect to the vertical, and the rollers 120, 121 are mounted on rocking connecting rods 123, which have the function of bringing the rollers 120, 121 up closer to the bar and moving them further away therefrom (FIGS. 7A, 7B).

In the present example of embodiment, the device 12 further comprises a vertical guide roller 122, which, in the present example of embodiment, is an idler roller and has the function of guiding the rolled material at output 8 from the second guide element in a vertical direction. The rolled material slides on a plate 124, set immediately beneath the vertical guide roller, only for a few instants in the step of start-up of winding until the material is tensioned and then comes into contact with the roller 122.

As illustrated in FIGS. 7A, 7B, when, at the start of winding of a new reel, the rolled bar BL is not yet slid through the device 12, the connecting rods 123 open, causing there to be between the rollers 120, 121 a distance significantly greater than the width of the bar BL (i.e., roughly leaving a gap of 10-20 mm between each roll and the side of a bar of cross section 50×5 mm). Once the latter has been slid in between the rollers 120, 121, the connecting rods rotate so as to bring the rollers 120, 121 almost up to the bar (i.e., reducing the gap between each roller and the side of the bar to roughly 0.7-1 mm).

Using the reeling device described previously, it is possible to obtain a more orderly arrangement of the turns on the reel, practically without any twisting or overlapping, which enables, in the processes located downstream, an increase in speed of unwinding of the skein that takes place continuously and without any jamming, with enormous advantages for the end user—for example, the drawer—in that it eliminates, or at least reduces considerably, any waste of time due to traditional drawbacks.

With the reeling device previously described it is moreover possible to obtain a more compact and cylindrical shape of the skein (optimal shape) and a greater coefficient of filling. The advantages that derive therefrom are smaller overall dimensions, a better exploitation of the storage space and also the optimization of transportation.

The device for distributing rolled bars and the corresponding operation described above may undergo numerous modifications and variations, without thereby departing from the scope of the present invention. For example, the distributor may comprise not just two guide elements 1, 2 but also three or four or a generic number N. The guide element 2, which is closer to the spindle M, may perform winding of a layer of turns with an angle of distribution β1 and winding of a second layer of turns, on top of the first, with an angle of distribution β2 equal, both in sign and in absolute value, to the angle β1. In this case, the value of the gap (g) between the turns of the inner layers will vary with respect to the value of those of the outer layers.

Any modification and variation that falls within the meaning and the range of equivalence of the claims is understood as being included herein.

The invention claimed is:

1. A reeling device for rolled material placed downstream of a rolling line, comprising at least one first guide element and one second guide element, each of them defining a passage designed to support, contain and guide said rolled material, where the first guide element is designed at least to rotate about an axis that is substantially normal to its own plane of lie and comprises one input end adapted to receive said rolled material coming off said rolling line, and one output end from which said rolled material may come out, and where the second guide element comprises one input end, set in the proximity of said output end of said first guide element, within which it is possible to introduce the rolled material that has come out of the first guide element, and one output end, from which said rolled material may come out towards winding means for winding the rolled material in turns, said winding means comprising a spindle of a reel, and defining a winding axis, and in which said first guide element and said second guide element are designed to vary their own inclination with respect to said winding axis independently of one another at least according to a plane parallel to the axis; said reeling device comprising orientation means of the second guide element so as to maintain the stretch of said rolled material coming out of said output end of said second guide element substantially with the same inclination as that of the last turn wound on said spindle according to a plane parallel to the winding axis of said turns, at least one first mobile support and one second mobile support suitable to translate in the direction parallel to the winding axis, and said second guide element is supported by said second mobile support substantially in the proximity of or in a position corresponding to said output end thereof, and is supported by said first mobile support substantially in the proximity of or in a position corresponding to said input end thereof, and said first guide element is supported by said first mobile support substantially in the proximity of or in a position corresponding to said output end thereof.

2. The device according to claim 1, wherein said second mobile support is provided with means designed to raise and lower the second guide element.

3. The device according to claim 2, further comprising a device for guiding the rolled material, having a space for passage, set downstream of said output end of said second guide element and suitable to be traversed by said rolled material, at least four rolls, arranged in pairs at both sides of said space for passage, at least four rotating connecting rods, on each of which one of said rolls is fixed in such a way that said connecting rods by rotating are designed to move said rolls closer together and further away from one another at the sides of said rolled material when it passes through said space or gap and control and actuation means designed to control and vary the position of said rolls at least in the horizontal direction so as to contain and guide laterally said rolled material.

4. The device according to claim 1, further comprising a device for guiding the rolled material, having a space for passage, set downstream of said output end of said second guide element and suitable to be traversed by said rolled material, at least four rolls, arranged in pairs at both sides of said space for passage, at least four rotating connecting rods, on each of which one of said rolls is fixed in such a way that said connecting rods by rotating are designed to move said rolls closer together and further away from one another at the sides of said rolled material when it passes through said space or gap and control and actuation means designed to control and vary the position of said rolls at least in the horizontal direction so as to contain and guide laterally said rolled material.

5. The device according to claim 4, wherein the device for guiding the rolled material comprises an idler roller, which has a function of guiding in a vertical direction the rolled material at output from the second guide element.

6. A method for reeling rolled material by means of a reeling device according to claim 1, wherein there are defined a winding axis and a rolling axis, and the first guide element and the second guide element vary their respective inclination with respect to the winding axis independently of one another, comprising the operation of displacing the output end of said second guide element along said means for winding rolled material in turns, by causing the first guide element to rotate at least about an axis substantially normal to its own plane of lie as long as said output end of said first guide element is within a region of space substantially delimited by two end surfaces, each of which is orthogonal to the axis of the winding means and passes in a position corresponding to one end of said winding means and maintaining said second guide element with an inclination, on a first plane parallel to the winding axis, wherein the stretch of rolled material coming out of said output end of said second guide element maintains during winding an angle of distribution, in said first plane substantially equal to the angle of the helix of the turns of the layer being wound, wherein the angle of the helix is inclined with respect to the rolling axis and the second guide element varies its inclination with respect to the winding axis during reeling.

7. The method according to claim 6, wherein said rotation of said first guide element about said axis substantially normal to its own plane of lie is stopped when said output end of said first guide element reaches one of said end surfaces and wherein said second guide element is made to rotate subsequently about an axis substantially normal to its own plane of lie at least until the output end of said second guide element substantially reaches one end of said winding means.

8. The method according to claim 7, wherein said second guide element raises during winding so as to follow the increase in diameter of the reel.

9. The method according to claim 6, wherein said second guide element raises during winding so as to follow the increase in diameter of the reel.

10. The method according to claim 9, wherein an operation of control of the position of the rolls of said guide device is carried out for guiding the rolled material so as to maintain substantially a gap not less than a predetermined value between said rolls and the sides of said rolled material.

* * * * *